US007750805B2

(12) United States Patent
Leggett et al.

(10) Patent No.: US 7,750,805 B2
(45) **Date of Patent: *Jul. 6, 2010**

(54) APPARATUS FOR RETROFITTING AUTOMATIC IRRIGATION SYSTEMS FOR ANIMAL AND HUMAN DETERRENT CONTROL

(76) Inventors: Curtis Stephen Leggett, 2502 Westview Terrance, Sooke, British Columbia (CA) V0S 1N0; Badi Dapilos Beattie, P.O. Box 121, Brooks, Alberta (CA) T1R 1B2

( * ) Notice: Subject to any disclaimer, the term of this patent is extended or adjusted under 35 U.S.C. 154(b) by 150 days.

This patent is subject to a terminal disclaimer.

(21) Appl. No.: 11/954,192

(22) Filed: Dec. 11, 2007

(65) Prior Publication Data

US 2008/0136630 A1 Jun. 12, 2008

Related U.S. Application Data

(60) Provisional application No. 60/874,114, filed on Dec. 12, 2006.

(51) Int. Cl.
*G08B 13/00* (2006.01)

(52) U.S. Cl. ..... 340/541

(58) Field of Classification Search ..... 340/541, 340/527, 565, 825.69, 284; 700/284
See application file for complete search history.

(56) References Cited

U.S. PATENT DOCUMENTS

| | | | | |
|---|---|---|---|---|
| 7,203,576 | B1 * | 4/2007 | Wilson et al. | 700/284 |
| 7,526,365 | B1 * | 4/2009 | Frerich et al. | 700/284 |
| 2004/0013468 | A1 * | 1/2004 | Kadner et al. | 405/37 |

* cited by examiner

*Primary Examiner*—Phung Nguyen
(74) *Attorney, Agent, or Firm*—Gordon Thomson

(57) ABSTRACT

An apparatus for retrofitting automatic irrigation systems for animal and human deterrent control comprises at least one motion detector for placement within a bordered zone monitored for trespassers. The motion detector is adapted to detect a body entering said bordered zone and generate a trespasser signal having a unique ID. A programmable control receiver module receives the signal and activates a solenoid control valve to spray the trespasser with water.

13 Claims, 3 Drawing Sheets

APPARATUS FOR RETROFITTING AUTOMATIC IRRIGATION SYSTEMS FOR ANIMAL AND HUMAN DETERRENT CONTROL

CROSS-REFERENCE TO RELATED APPLICATIONS

This application claims the benefit of U.S. Provisional Patent Application No. 60/874,114 filed in the U.S. patent and Trademark Office on Dec. 12, 2006 and entitled "Retrofit animal and human deterrent control for automatic irrigation systems".

FIELD OF THE INVENTION

The present invention relates to an apparatus for retrofitting automatic irrigation systems for animal and human deterrent control and more particularly an apparatus that comprises a control module that attaches to automatic irrigation controllers and is in wireless communication with motion detectors capable of activating a zone valve within an irrigation system in response to the detection of motion in order to spray the trespasser with water.

BACKGROUND OF THE INVENTION

Irrigation systems typically consist of a plurality of sprinklers, electric zone valves, and an electric controller. Individual sprinklers are fed by underground water pipes connected to a water supply source through electrically operated solenoid zone valves. The zone valves are typically AC powered solenoid valves which are hard wired directly to the controller. Control wires connect the controller to the solenoid valves which are usually buried underground.

Typical controllers are AC powered and are mounted on a wall near an AC outlet either indoors or outdoors. The controllers are typically of solid state design and allow the user to control the sequence of zones to be watered, the start time of each watering, the duration of each watering, and the interval between watering events.

Residential and commercial properties that have irrigation systems installed typically take pride in the beauty of the lawn and flora, and perhaps the productivity of vegetables gardens. However, these irrigation systems do not offer any animal or human security or deterrent benefits to the property. Animal and human security deterrent systems are typically stand-alone systems and not integrated with current automatic irrigation systems. This creates added cost and complexity to installing a stand-alone trespasser deterrent system. Therefore, there is a requirement for a human and animal deterrent control apparatus that can be retrofitted onto an existing automatic irrigation system easily and inexpensively.

SUMMARY OF THE INVENTION

A solution to the shortcoming of irrigation systems mentioned above has been devised. The present invention relates to an apparatus for retrofitting an automatic irrigation control system. The apparatus comprises a retrofit control receiver module and at least one retrofit motion sensor. The retrofit controller attaches to the automatic irrigation controller. In another embodiment of the invention a retrofit remote control can also be used in parallel with the retrofit controller. The retrofit controller is capable of wirelessly receiving control signals from the at least one retrofit motion sensor. It can also receive signals from various other remote devices such as the retrofit handheld remote control pad, retrofit water flow monitors, and retrofit rain detectors to name a few.

In one embodiment of the invention the apparatus comprises a Control Receiver module (CRX) and at least one Motion Transmitter (MTX) module(s) although the apparatus may comprises a plurality of MTX modules. The CRX has the ability to incorporate remote controllers in the form of handheld pads for on/off transmitters and other sensors such as moisture detectors, rain detectors, water flow detectors, and water pressure detectors to name a few. The CRX comprises an RF receiver in order to receive RF field signals from the MTX modules. The CRX further comprises a programmable microcontroller, LCD displays and/or LED lights for visual status reports to the user and user input buttons for programming functions. The MTX comprises an RF transmitter module, and a motion detector Device. The MTX is adapted for user control of various parameters such as ON/OFF functions, motion sensitivity adjustment, zone selection where the host irrigation system is divided into zones, day/night mode, and RF encoder/decoder addressing.

In one embodiment of the apparatus, the MTX units transmit RF trespasser detection signals to the CRX when trespasser motion is detected in the monitored zone. A plurality of motion detectors can be installed in a plurality of zones. Specific zone numbers, motion sensitivity, day/night mode, and RF encoder addressing may be user adjustable for each MTX. When the CRX receives the RF trespasser detection signal from the MTX a determination is made by the microcontroller within the CRX whether a trespasser alert is warranted. If so, the appropriate zone valve is energized and water is sprayed on the trespasser.

The CRX enables the reception of RF signals and commands via a wireless communication link rather than conductor wires. In this way, the apparatus can circumvent physical obstacles, structures or distances that would otherwise prohibit or make impractical a hardwired implementation. The CRX can be programmed to maintain a monitoring schedule of selectable operation times for the MTXs. Different start times and stop times of motion detection periods can be selected to enable and disable the MTXs.

The CRX power supply uses the 24 Vac low voltage of the sprinkler timer to power the solenoid valves, and has a rectification circuit that converts the 24 Vac to a logic level DC voltage.

DESCRIPTION OF THE INVENTION

The following descriptions and the figures, to which it refers, are provided for the purpose of describing examples and specific embodiments of the invention only and are not intended to exhaustively describe all possible examples and embodiments of the invention. Many specific implementations of the following described Apparatus for Retrofitting Automatic Irrigations Systems for Animal and Human Deterrent Control will be apparent to those skilled in the art.

Figure 1:
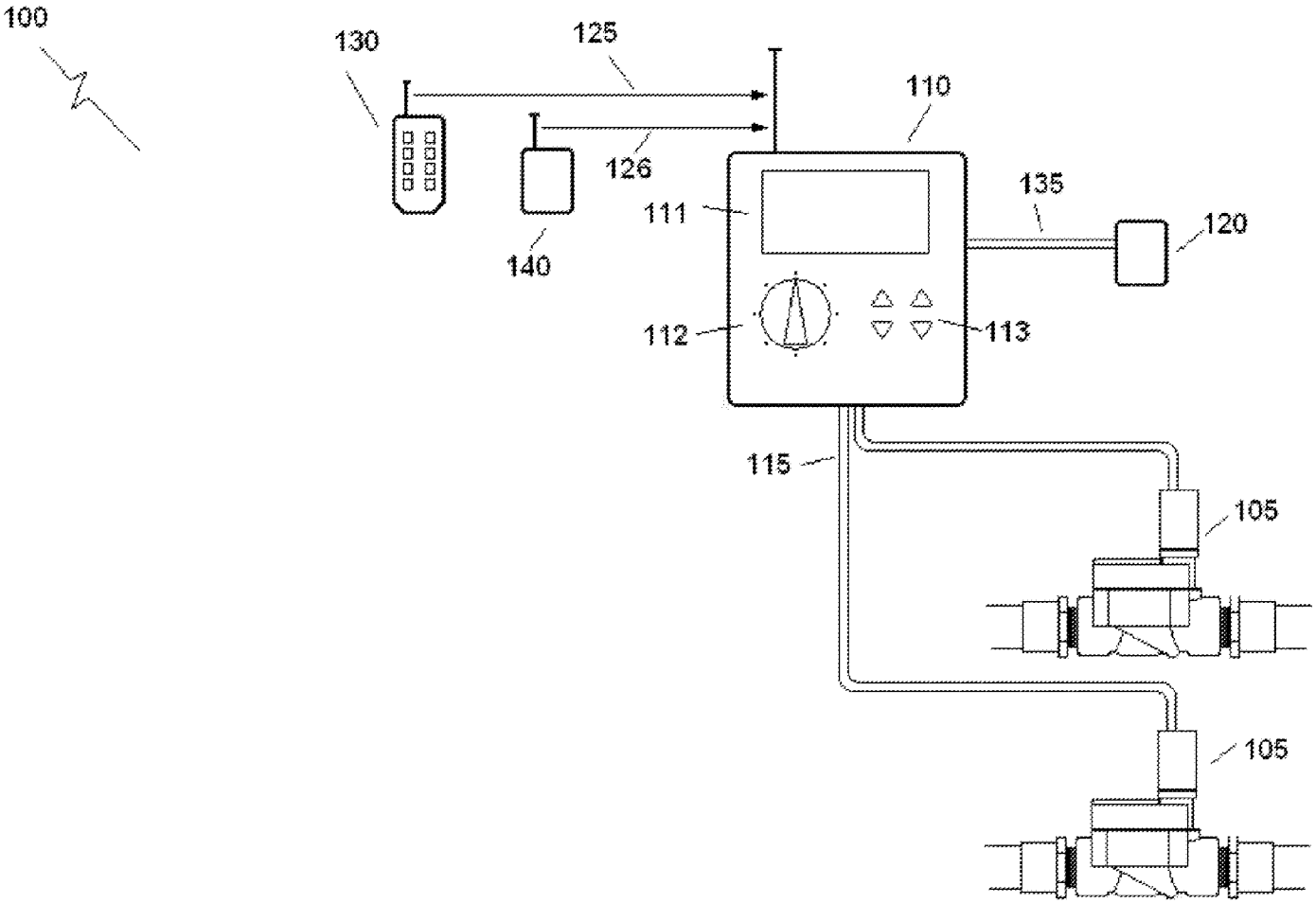
FIG. 1 is a schematic of a typical automatic irrigation control system.

FIG. 1 shows a schematic of a typical solid-state centralized irrigation control system 100. The AC powered automatic sprinkler control timer (controller unit) 110 is connected by conductor wires 115 and 135, to one or more solenoids 105 controlling the ON/OFF operation of the sprinklers, and/or field sensors 120 respectively. The controller unit 110 is connected via wireless communication links 125 and 126, to wireless field sensors 140, and/or a wireless On/Off remote control unit 130 respectively. The controller unit 110 contains an LCD 111 for viewing programming information, and different combinations of pushbuttons 113 and dials 112 for user entry of programming information.

Figure 2:
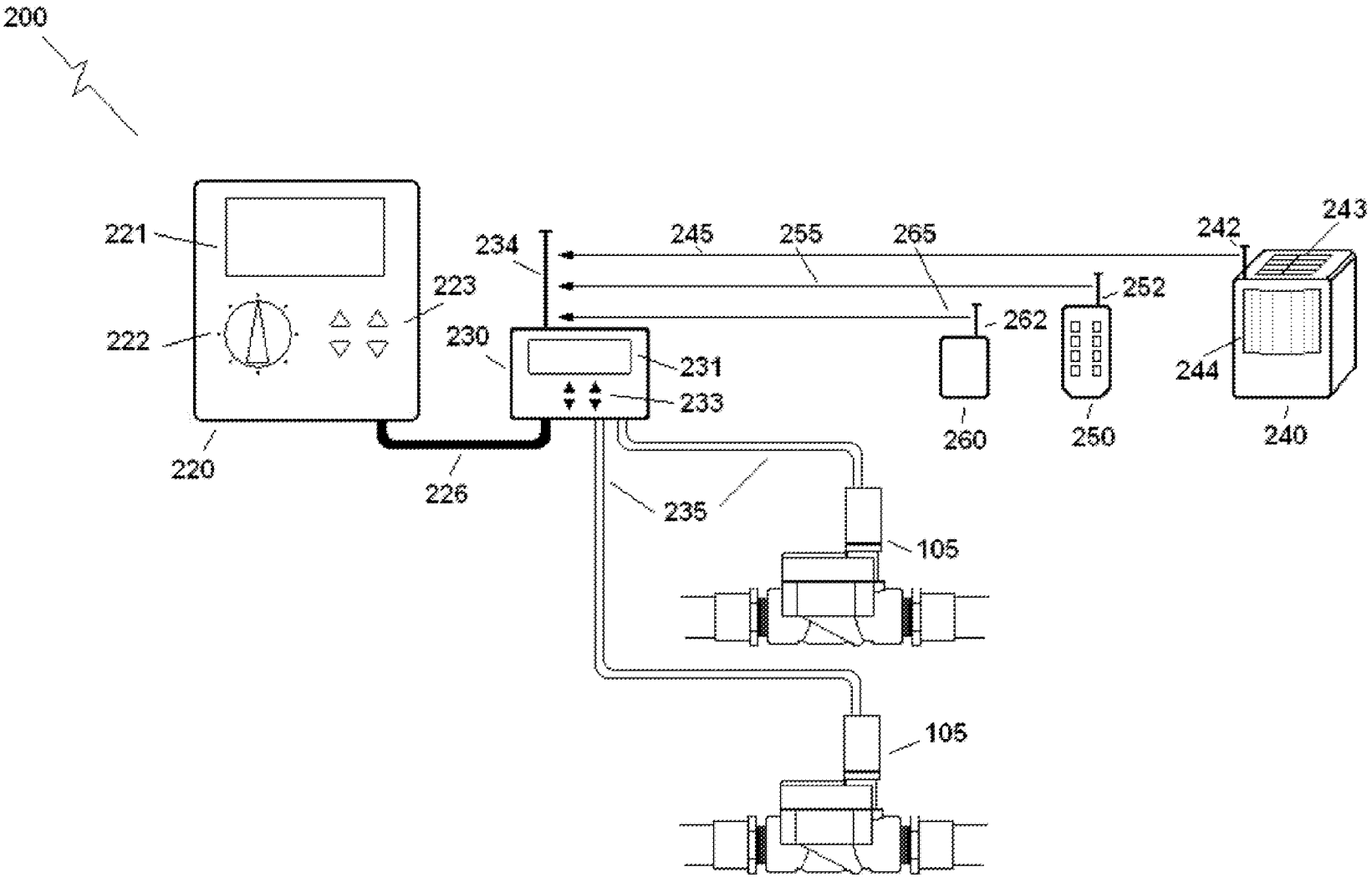
FIG. 2 is a schematic view of the Apparatus for Retrofitting Irrigation Systems for Animal and Human Deterrent Control for installation on the irrigation control system of FIG. 1.

Referring now to FIG. 2, a schematic of an embodiment of one embodiment of the invention is shown, namely, an irrigation system employing the Apparatus for Retrofitting an Automatic Irrigation System for Animal and Human Deterrent Control 200. FIG. 2 includes a typical irrigation system controller 220, an at least one CRX module 230 connected to at least one solenoid valve 105 by wires 235, at least one MTX module 240, at least one KTX module for remote operation 250, and other wireless sensors 260 such as rain monitors. The apparatus also comprises a rectification circuit (FIG. 3) to provide DC voltage to the programmable control receiver module from the at least one automatic sprinkler control timer low voltage AC supply.

In order for the CRX 230 to successfully receive multiple signals from a plurality of RF transmitters that may be in the same CRX control zone each RF transmitter is provided a unique RF signature in the form of a unique address or ID. Additionally, each CRX could have a unique addresses or ID in order to distinguish it from a CRX controlling a neighboring zone. This would allow multiple CRXs to be placed in close proximity to one another without causing any undesirable affects.

In the embodiment shown in FIG. 2, CRX 230 is hardwired directly to the irrigation system controller 220, and to the solenoid zone valves 105 by the conductor wires 226 and 235 respectively. The CRX activates the solenoid valves by an open valve signal or a close valve signal according to the received signals from the Irrigation Controller 220, MTX 240, KTX 250, and Remote Sensors 260.

The CRX 230 permits regular operation of the irrigation system controller 220 by allowing the irrigation system control signals to propagate through the conductors 226 through CRX 230 to the solenoid valves 105 via the conductor wires 235. However, CRX 230 has the ability to override and pre-empt the control signals of the Irrigation system Controller 220 so that it can control the appropriate solenoid zone valves 105 when it receive a trespass signal from MTX module 240, or a control signal from the KTX 250 or other Remote Sensors 260. The CRX can also be programmed to operate on a time-based schedule, such as, during certain hours of the day or certain days of the week.

CRX 230 comprises an RF receiver and antenna 234 that is in wireless communication with MTX antenna and transmitter 242 via a unique RF link 245, KTX antenna and transmitter 252 via a unique RF link 255, and other wireless sensors antenna and transmitters 262 via a unique RF link 265. CRX 230 receives control signals from the Irrigation System Controller 220 via conductor wires 226.

CRX 230 comprises a LCD 231 for viewing programming information, and different combinations of pushbuttons 233 for user entry of programming information. An LED may also be used and operating information transmitted to the user by blinking the LED at predetermined frequencies representing various operating modes or troubles.

In one embodiment of the invention the apparatus comprises single units of the CRX 230, MTX 240, KTX 250, and other sensors 260. However, in other embodiments of the invention, the apparatus may comprise a plurality of these units to accommodate the size of area to be monitored for trespassers.

Other embodiments of the apparatus include any combination of the above mentioned features of the individual modules CRX 230, MTX 240, KTX 250, and Remote Sensors 260.

The MTX 240, consists of an Infrared motion sensor and optical view finder 244. The MTX 240, may be DC powered by a battery. The battery may be recharged by a photovoltaic cell 243, integral to the MTX. In another embodiment the MTX can be powered by a super capacitor that is re-chargeable by a photovoltaic cell 243, integral to the MTX.

Figure 3:
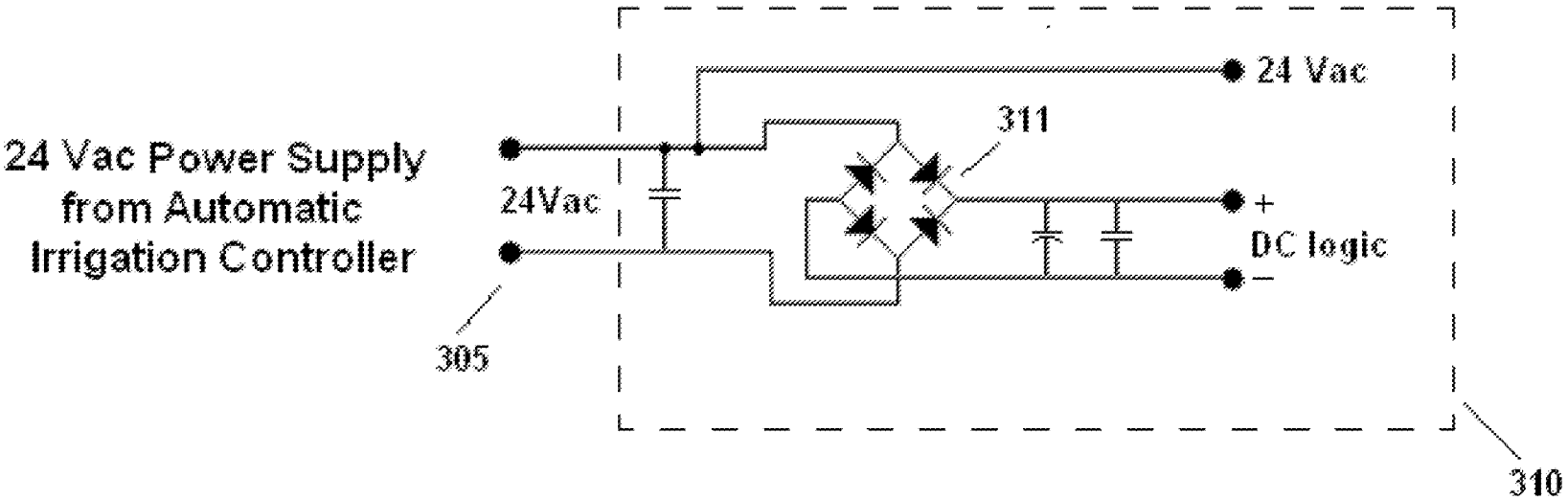
FIG. 3 is a schematic view of the power supply of the Wireless Valve Controller of FIG. 2.

FIG. 3 includes the CRX power supply 310, which connects to the 24 Vac terminals 305, of the Automatic Irrigation Controller 220, to power the solenoid valves 105, and has a bridge rectification circuit 311, that converts the 24 Vac to a logic level DC voltage.

The invention includes a method of retrofitting an automatic irrigation system into a human and animal deterrent system. The automatic irrigation system comprises at least one sprinkler, at least one solenoid zone valve in operative communication with the at least one sprinkler, at least one low voltage AC powered programmable automatic sprinkler control timer having a pre-programmed watering schedule in operative communication with the at least one solenoid control valve. The method comprises the steps of:

a. Providing a retrofit kit comprising:
   i. At least one motion detector for placement within a bordered zone, said at least one motion detector adapted to detect a body entering said bordered zone and generate a trespasser signal, the at least one motion detector further adapted to transmit said trespasser signal with a unique ID to;
   ii. a programmable control receiver module adapted to receive the trespasser signal with said unique ID, wherein said programmable control receiver module is in controlling communication with said at least one solenoid control valve; so that,
   iii. when the trespasser signal is received by the programmable control receive module an open valve signal is transmitted to the at least one solenoid valve for a predetermined amount of time thereby spraying said body with water and deterring its movement into the bordered zone;
b. placing the at least one motion detector within said bordered zone;
c. placing the programmable control receiver module in controlling communication with the at least one solenoid valve;
d. programming the programmable control receiver module to pre-empt said pre-programmed watering schedule upon detection of the trespasser signal; and,
e. programming the programmable control receiver module to operate on a pre-determined time-based schedule.

The invention also comprises a retrofit kit for retrofitting an automatic irrigation system into a human and animal deterrent system, said automatic irrigation system comprising at least one sprinkler, at least one solenoid zone valve in operative communication with said at least one sprinkler, at least one low voltage AC powered programmable automatic sprinkler control timer having a pre-programmed watering schedule in operative communication with said at least one solenoid control valve, said retrofit kit comprising a. At least one motion detector for placement within a bordered zone, said at least one motion detector adapted to detect a body entering said bordered zone and generate a trespasser signal, the at least one motion detector further adapted to transmit said trespasser signal having an unique ID to;

b. a programmable control receiver module adapted to receive the trespasser signal with said unique ID, wherein said programmable control receiver module is in controlling communication with said at least one solenoid control valve; so that, c. when the trespasser signal is received by the programmable control receive module an open valve signal is transmitted to the at least one solenoid valve for a predetermined amount of time thereby spraying said body with water and deterring its movement into the bordered zone.

Although this description has much specificity, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. Apparatus for retrofitting automatic irrigation systems for animal and human deterrent control, wherein said automatic irrigation system comprises at least one sprinkler, at least one solenoid valve in operative communication with said at least one sprinkler and at least one low voltage AC powered programmable sprinkler control timer having a pre-programmed watering schedule in operative communication with said at least one solenoid valve, wherein said apparatus comprises:

a. At least one motion detector for placement within a bordered zone monitored for trespassers, said at least one motion detector adapted to detect a body entering said bordered zone and generate an RF trespasser signal, the at least one motion detector further adapted to transmit said RF trespasser signal with a unique ID adapted for distinguishing the trespasser signal from other control signals to;

b. a programmable control receiver module adapted to receive the RF trespasser signal with said unique ID, wherein said programmable control receiver module is in controlling communication with said at least one solenoid control valve; so that, c. when the RF trespasser signal is received by the programmable control receive module an open valve signal is transmitted to the at least one solenoid valve for a predetermined amount of time thereby spraying said body with water and deterring its movement into the bordered zone.

2. The apparatus of claim 1 wherein the programmable control receiver module further comprises an operating indicator to provide a user with data relative to the operation of the programmable control receiver module and motion detector modules.

3. The apparatus of claim 2 wherein in said operating indicator is an LED adapted to display said data by way of blinking the LED at predetermined frequencies.

4. The apparatus of claim 3 wherein the operating indicator is an LCD screen adapted to display operating data in a readable format.

5. The apparatus of claim 4 wherein the programmable control receiver module is programmed by said user to function on a time-based schedule.

6. The apparatus of claim 5 wherein the at least one motion detector includes a daylight sensor permitting the at least one motion detector to detect the trespassing body in day and night lighting conditions.

7. The apparatus of claim 6 wherein the at least one motion detector is powered by a DC power source.

8. The apparatus of claim 7 wherein said DC power source is a DC battery.

9. The apparatus of claim 8 wherein said DC battery is re-chargeable by at least one photovoltaic cell.

10. The apparatus of claim 7 wherein the DC power source comprises at least one super capacitor re-chargeable by at least one photovoltaic cell.

11. A method of retrofitting an automatic irrigation system into a human and animal deterrent system, said automatic irrigation system comprising at least one sprinkler, at least one solenoid zone valve in operative communication with said at least one sprinkler, at least one low voltage AC powered programmable automatic sprinkler control timer having a pre-programmed watering schedule in operative communication with said at least one solenoid control valve, said method comprising the steps of:

a. Providing a retrofit kit comprising:

i. At least one motion detector for placement within a bordered zone, said at least one motion detector adapted to detect a body entering said bordered zone and generate a trespasser signal, the at least one motion detector further adapted to transmit said trespasser signal with a unique ID to;

ii. a programmable control receiver module adapted to receive the trespasser signal with said unique ID, wherein said programmable control receiver module is in controlling communication with said at least one solenoid control valve; so that, iii. when the trespasser signal is received by the programmable control receive module an open valve signal is transmitted to the at least one solenoid valve for a predetermined amount of time thereby spraying said body with water and deterring its movement into the bordered zone;

b. placing the at least one motion detector within said bordered zone;

c. placing the programmable control receiver module in controlling communication with the at least one solenoid valve;

d. programming the programmable control receiver module to pre-empt said pre-programmed watering schedule upon detection of the trespasser signal; and, e. programming the programmable control receiver module to operate on a pre-determined time-based schedule.

12. A retrofit kit for retrofitting an automatic irrigation system into a human and animal deterrent system, said automatic irrigation system comprising at least one sprinkler, at least one solenoid zone valve in operative communication with said at least one sprinkler, at least one low voltage AC powered programmable automatic sprinkler control timer having a pre-programmed watering schedule in operative communication with said at least one solenoid control valve, said retrofit kit comprising:

a. At least one motion detector for placement within a bordered zone, said at least one motion detector adapted to detect a body entering said bordered zone and generate a RF trespasser signal, the at least one motion detector further adapted to transmit said RF trespasser signal having an unique ID to;

b. a programmable control receiver module adapted to receive the RF trespasser signal with said unique ID, wherein said programmable control receiver module is in controlling communication with said at least one solenoid control valve; so that, c. when the RF trespasser signal is received by the programmable control receive module an open valve signal is transmitted to the at least one solenoid valve for a predetermined amount of time thereby spraying said body with water and deterring its movement into the bordered zone;

d. wherein the programmable control receiver module further comprises an operating indicator to provide a user with data relative to the operation of the programmable control receiver module and motion detector modules;

e. wherein in said operating indicator is an LED adapted to display said data by way of blinking the LED at predetermined frequencies;

f. wherein the operating indicator is an LCD screen adapted to display operating data in a readable format: and, g. wherein the programmable control receiver module is programmed by said user to function on a time-based schedule.

13. The apparatus of claim 12 wherein the at least one motion detector is DC powered and includes a daylight sensor permitting the at least one motion detector to detect the trespassing body in day and night lighting conditions.

* * * * *